United States Patent [19]

Davis, Jr.

[11] 3,985,273

[45] *Oct. 12, 1976

[54] CAULKING GUN ADAPTER FOR AN ELECTRIC HAND DRILL

[76] Inventor: George B. Davis, Jr., 7512 Marbury Road, Bethesda, Md. 20014

[ * ] Notice: The portion of the term of this patent subsequent to Jan. 21, 1992, has been disclaimed.

[22] Filed: June 12, 1975

[21] Appl. No.: 586,513

Related U.S. Application Data

[63] Continuation-in-part of Ser. No. 446,961, Feb. 28, 1974, Pat. No. 3,913,799.

[52] U.S. Cl. ..... 222/326; 222/333; 222/386

[51] Int. Cl.[2] ..... B67D 5/46

[58] Field of Search ..... 222/325–327, 222/386, 333, 390

[56] References Cited

UNITED STATES PATENTS

| | | | |
|---|---|---|---|
| 3,208,638 | 9/1965 | Frenzel et al. | 222/333 |
| 3,635,378 | 1/1972 | DeHart | 222/333 |
| 3,854,629 | 12/1974 | Blieberger | 222/333 X |
| 3,861,567 | 1/1975 | Davis, Jr. | 222/333 |
| 3,913,799 | 10/1975 | Davis, Jr. | 222/390 X |

*Primary Examiner*—Robert B. Reeves
*Assistant Examiner*—Charles A. Marmor

[57] ABSTRACT

This invention relates generally to caulking devices and particularly to a caulking gun attachment for an electric hand drill that includes apparatus for securing the gun to the drill and drivably connect the drill therewith whereafter upon operation of the drill a caulk-driving piston is forced through the caulk retaining receptacle of the gun in a manner to force caulking from the gun with considerable force and at a continuous easy to control flow yet including clutch for drivably disengaging the piston from the drill should a reacting force upon the piston exceed a predetermined valve. The gun further includes an arrangement for releasing the piston of its driving linkage to allow manual movement of the piston.

12 Claims, 9 Drawing Figures

Fig. 1
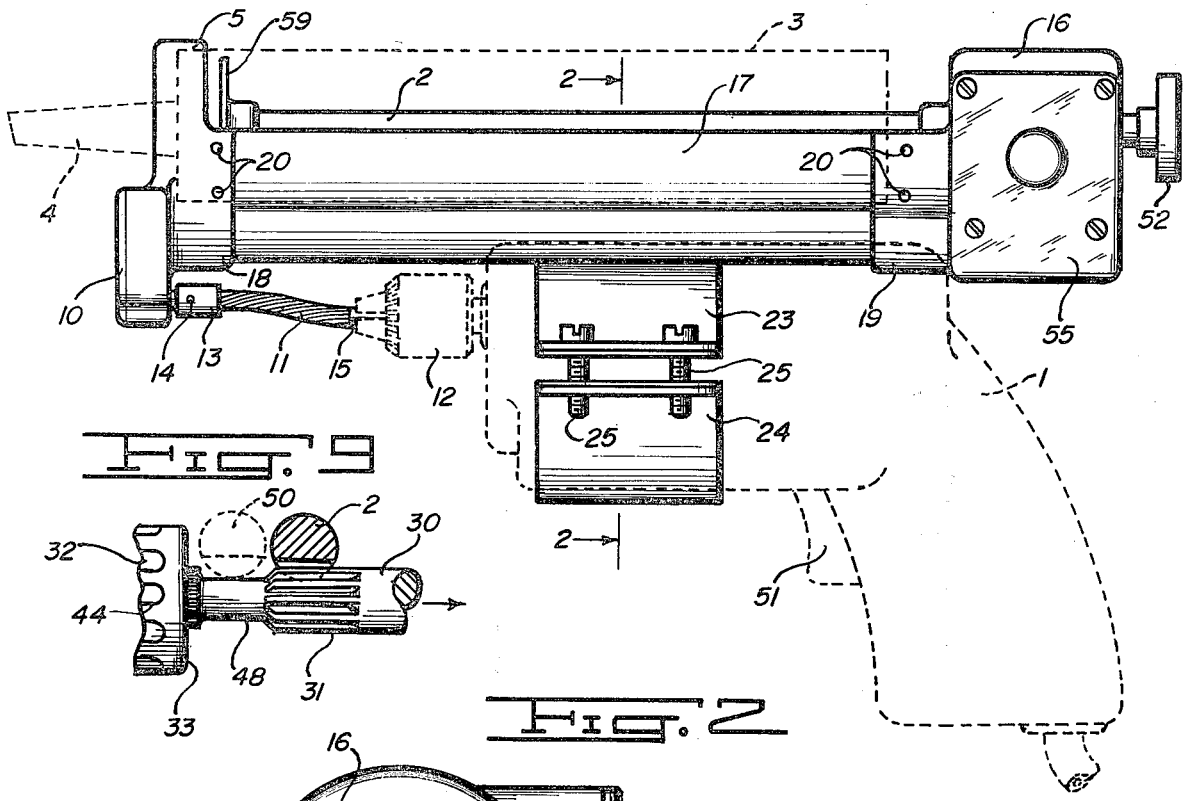
Fig. 9
Fig. 2
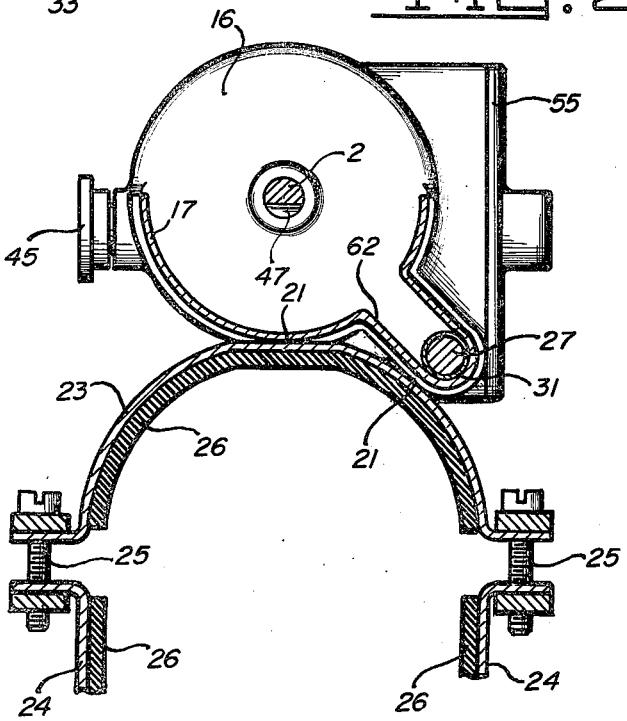
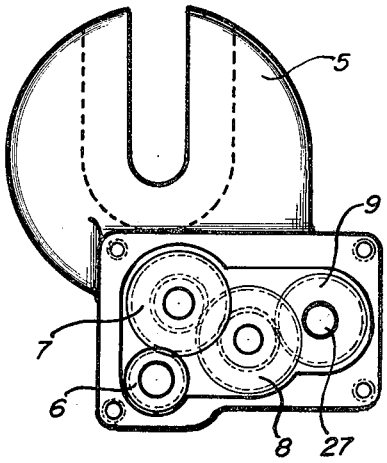
Fig. 3

CAULKING GUN ADAPTER FOR AN ELECTRIC HAND DRILL

This application is a continuation in part of application Ser. No. 446,961 filed Feb. 24, 1974 and now U.S. Pat. No. 3,913,799 issued Oct. 21, 1975.

Caulking guns are well known in the art and are designed to dispense caulking from a caulk retaining receptacle by way of a tubular like projection or nozzle that serves to direct the caulking from the receptacle and into the particular crack or crevice to be filled. The caulking gun may be so formed as to include a refillable caulk retaining receptacle or to receive therein a caulk filled disposable cartridge depending upon the particular design of the gun. With such caulking apparatus a movable piston is forced through the receptacle to drive caulking therein from the nozzle of the gun.

While electrically powered guns are known in the art, generally with small inexpensive guns, the pistons of such guns are driven by variously constructed hand operated leverage mechanisms which serve to multiply the force applied to more easily urge the piston through the gun. It is well known, however, that even with the mechanical advantage offered by such force multiplying mechanisms, the effort required to drive caulking from a caulking gun is considerble and frequently beyond the gripping capability of many, particularly the aged or those crippled as with arthritis or the like, yet in many instances, the very livelihood of such individuals with trades such as painters, boatmen and general home repair men depend upon operating such caulking guns.

It is the primary object of the present invention to provide an inexpensive caulking gun attachment for a conventional electric hand drill wherein the drill will operate to provide the necessary power required to force caulking from the gun nozzle and in a manner to permit even a child to dispense caulking of the most viscous composition from the gun under high pressure and at a continuous easy to control flow.

A further object is to provide a caulking gun attachment for an electric hand drill wherewith upon emptying of the caulk retaining cartridge or receptacle or upon any other form of forceful retardation of piston movement beyond that desired, a clutch mechanism within the drive train will operate to drivably disengage the piston from its drive linkage with the drill thusly preventing damage to the drive mechanism of the device.

Another object is to provide a caulking gun attachment for an electric hand drill wherein the clutch mechanism may be adjusted to provide a continuously slipping linkage between the piston and drill inabling the operator to vary selectively the pressure at which the caulking is dispensed from the gun and also the rate at which the caulking will flow from the dispensing nozzle.

A still further object is to provide a caulking gun wherein the caulk-driving piston may be quickly disengaged from the drive linkage to allow rapid manual movement of the piston.

Another object is to provide a caulking gun attachment for an electric hand drill which, upon reversal of the drill or drive linkage, the piston will be forcefully withdrawn from the caulk retaining receptacle of the gun. 23

A still further object is to provide a drill powered caulking gun wherein a metallic tubular supporting sleeve may be telescoped over the cylindrical caulking cartridge before insertion of the latter within the gun to prevent rupture of the cartridge casing should the piston pressure upon the caulking within the cartridge exceed the strength of the cartridge casing.

Another object is to provide a rugged, inexpensive caulking gun attachment for an electric hand drill that is light in weight dependable in operation and readily adaptable to various sizes and shapes of drills with which the device may be used in service.

Other objects and advantages will become more apparent when referring to the accompanying description and drawings wherein:

FIG. 1 is a side view in elevation of the caulking gun of the invention as mounted upon and drivably connected with a conventional electric hand drill.

FIG. 2 is a view in cross-section of the gun as taken along 2—2 of FIG. 1.

FIG. 3 is a front view in elevation of the forward housing of the gun with the gear cover plate removed.

FIG. 9 shows an alternate arrangement for modifying the pinion gear for allowing manual movement of the piston.

Figure 8:
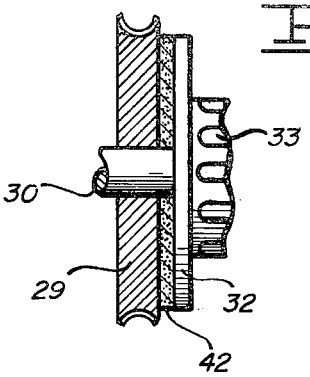
FIG. 8 is a fragmentary view, partly in elevation, of an alternate clutch mechanism of the device.

FIG. 1 shows the caulking gun of the present invention as mounted upon and clamped to an electric hand drill 1 that, in use of the device, provides the power source for driving the rack piston 2 of the gun through a caulk retaining receptacle or cartridge 3 in a manner to force the caulking therein from the dispensing nozzle portion 4 thereof under high pressure.

The gun includes a forward housing 5 that is formed preferably as a light metallic diecasting and wherein in FIG. 3, is shown to inclose a cluster of gears 6, 7, 8, and 9 that form a part of the speed reducing drive train of the device. The gear case within the forward housing is normally closed by means of a cover plate 10 as shown in FIG. 1.

Extending rearward from gear 6 is a length of flexible shaft or cable 11 that connects with the drill by being clamped within the jaws of the drill chuck 12 and by means of which power from the drill is applied to the mechanism of the gun. The flexible shaft 11 is secured preferably as by swaying within a coupling member 13 which is attached to the gear driving shaft as by pin 14. The strands of the cable, desirably, are fused together as by soldering at 15 to inable the cable to be more readily seized by the jaws of the drill chuck. The flexible nature of the cable or shaft 11, permits out-of-line coupling of the gun with the various shapes and sizes of drills with which the gun may be used in service. While herein is shown the drill as coupled with the gun by means of the flexible shaft 11, it is understood that here any suitable form of telescoping universal joint linkage will suffice at a slight increase in cost.

The forward housing 5 is connected to the rear housing 16 of the gun by means of a cradle-like cartridge receiving receptacle 17 that lies within extensions 18 and 19 projecting from the housings and to which the receptacle 17 is secured as by rivits 20. The rear housing 16 includes other components of the drive mechanism of the gun each as a clutch mechanism and piston disengaging linkage as will hereafter be more fully described.

Secured to the receptacle 17 as by spot welding thereto at 21, FIG. 2 is a crescent-like clamping bracket 23 which, along with clamping member 24, is operative to secure the gun to the body of the drill as screws 25 are tightened. Each of the clamp sections 23 and 24 include a resilient lining 26 such as rubber or plastic that operate to provide a more positive frictional bond between the clamp and drill as the gun is mounted upon the drill and clamped thereto.

Figure 5:
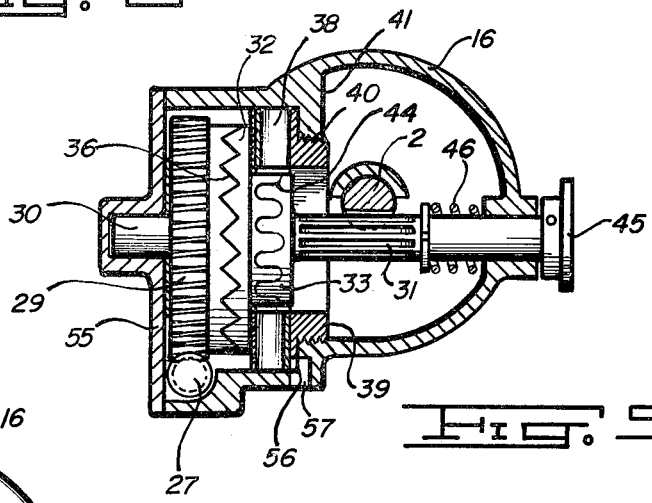
FIG. 5 is a sectional view, partly in elevation, through the rear housing of the device.
Figure 4:
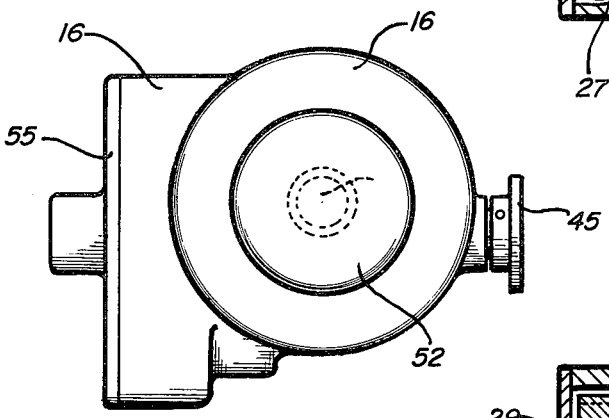
FIG. 4 is a view in elevation of the rear housing as viewed from the rear of the gun.
Figure 6:
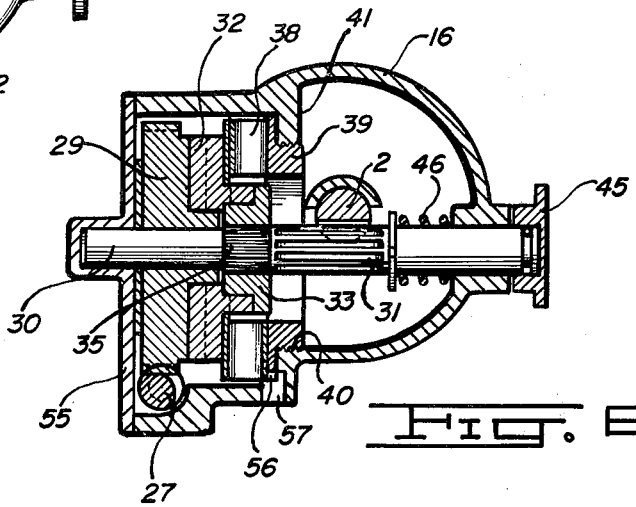
FIG. 6 is a sectional view, partly in elevation, through the rear housing of the gun.

Extending rearward from gear 9 and into the housing 16 is a drive shaft 27 that, during operation of the drill, applies rotary motion from gear 9, by means of a worm gear thereon to a wheel gear 29 disposed within the rear housing, FIGS. 5 and 6, and freely rotatable about shaft 30. This drive shaft 27 is inclosed within a protective tubular guide 31, FIG. 2, that extends between the housings and rests within a protective recess 62 formed within the sheet metal receptacle 17.

While gear 29 is free to rotate about shaft 30, it is rigidly maintained in driving relation with the piston driving pinion gear 31 through clutch member 32 and member 33 with the latter being secured to the shaft 30 as by being pressed over a knurled portion of the shaft as at 35. Teeth 36 provided upon the side of gear 29 are maintained in tightly meshing relation with similarly formed teeth upon the clutch member 32 that is also disposed to freely rotate about shaft 30.

These teeth 36 of the clutch may be of any size or shape suitable for the purpose and are forcefully pressed together in driving relation between the parts 29 and 32 by means of an annular spring washer 38 interposed between the rear face of the clutch member 32 and a backup adjustable ring washer 39. The ring washer 39 is threaded at 40 for adjustment axially within an internal flange 41 formed within the housing 16 as shown. This arrangement of the clutch mechanism within the drive train provides that should a stopping or a predetermined retarding or arresting force by applied to the piston during such time as the drill is in operation, the teeth 36 of the clutch will override in a manner to allow slippage between the clutch faces until the piston is freed or power to the drill is interrupted.

While the meshing teeth 36, as are herein provided upon the clutch faces, will deliver high torque loads before slipping, it is understood that here a frictional connical clutch or frictional dish as shown by 42, FIG. 8, will also suffice with the modification of gear member 29 and clutch member 32 by removing teeth 36. Such a clutch mechanism would be more desirable than the teeth should certain operational requirement of the gun be desired and as will hereafter be more fully described.

Figure 7:
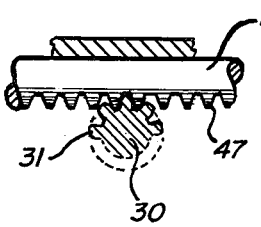
FIG. 7 is a fragmentary view showing the arrangement of the pinion gear and rack gear piston as related to the piston supporting member within the housing.

In order to free the rack piston from the drive linkage to allow manual movement of the piston, there is provided between the clutch member 32 and the shaft driving member 33, a plurality of meshing teeth 44 with these teeth being so formed as to engage and lock with each other in the manner of a spline to provide a positive driving linkage between the clutch member 32 and pinion gear 31 which drives the rack piston 2 through the gun. Separation of these teeth 44, by manual withdrawal of shaft 30 by knob 45 and against the return spring 46, separates the teeth 44 to free shaft 30 allowing manual movement of the piston as the rack gear 47 upon the piston rotates the now free pinion gear 31. During axial movement of shaft 30, the pinion gear 31 remains in mesh with the rack gear 47 as apparent from the structure shown in FIGS. 5, 6, and 7.

If desired, a structure may be provided such as illustrated in FIG. 9 wherein a section of gear 31 is removed as at 48 allowing, as shaft 30 is outwardly withdrawn, to position this gear free section 48 beneath the rack gear of the piston as shown by 50 and in this manner drivably disengage the piston from the drive linkage allowing manual movement of the piston. The rear housing 16 is shown as closed by the cover plate 55.

When operating the gun described, the shaft 30 is first withdrawn by knob 45 to separate teeth 44 permitting manual movement of the piston by means of knob 52 thereon thereby allowing the rack gear 47 upon the piston to rotate the now free pinion gear 31. After retraction of the piston, a caulking cartridge may be inserted within the gun and the piston then directed manually inward against the caulk driving plate within the cartridge. As knob 45 is released, spring 46 returns the shaft 30 to its innermost position to immesh teeth 44 thusly drivably connecting the rack piston through the clutch and gear linkage again with the drill chuck 12. With the gun thusly readied for operation, subsequent depressing of the drill energizing trigger 51 will effect operation of the drill and movement of the rack piston through the receptacle of the gun to force caulking therein from the nozzle under high pressure and at a continuous easy to control flow.

Upon emptying of the caulking cartridge and by the piston reaching the end of its forward stroke, instead of the drive linkage of the gun being damaged, as would otherwise be the case, the teeth 36 of the clutch within the drive train operates to override and in this manner disconnects the drive linkage between the drill and piston until current to the drill is interrupted at the drill control switch.

The necessity for such a clutch mechanism within the drive train of the device will become apparent when it is realized that the average load speed of an electric hand drill is approximately 1,200 rpms and which is being reduced by the gear linkage to 1½ rpm's at the pinion gear 31. This pinion gear speed will drive the piston through the gun at approximately 1½ inches per minute or at a speed deemed satisfactory for properly controlling the flow of caulking being extruded from the gun. Obviously, from the ratio of the back-gearing required, the force at the low end of the drive is considerable and of a character that would quickly bindup or damage the mechanism of the gun should the piston be stopped or otherwise restrained as by the operator attempting to force old and setup caulking from the gun. Additionally, there is certain types of caulking that must be applied hot and if allowed to sufficiently cool within the gun, will overload or stop the piston. If such occurs, because of the extensive back-gearing within the device, such overloading of the piston will, unfortunately, not be felt by either the operator or drill until damage has occurred at the low end of the drive. In this case, however, the clutch will immediately feel this piston arresting load and drivably disconnect the piston from the power source.

While herein is shown a clutch that is comprised of meshing teeth 36 and which is considered the most positive trouble-free linkage of its type, it is understood that if desired, a frictional connical clutch or disk clutch could here be employed should the need for a continuously slipping clutch be desired. Such a clutch, and as shown in FIG. 8, when properly adjusted as by rotation of the clutch adjustment ring 39, will affect a condition of continuous slippage in the device train linkage enabling the operator to selectively regulate the pressure the caulking is dispensed from the gun, as say from 10 psig to 100 psig. Since the clutch rotary speed is approximately 1½ rpm's, the necessary clutch slippage to produce these varying pressures will be in the order of only a few degrees per minute and which no frictional heat and relatively no clutch wear.

Rotation of the clutch adjustment ring 39 may be accomplished in various ways as by a gear and key, such as the drill chuck 12, however here, since very little adjustment will ever be needed, notches 56 are provided about the periphery of the ring 39 and engagable for adjustment by means of a screwdriver or the like being inserted through the opening 57 provided therefor within the housing to engage the notches 56 within the ring and by leverage rotate the ring.

The drive protecting clutch mechanism within the drive linkage between the drill and piston, protects the linkage in such a manner as to enable many of the components being inexpensively molded from plastic such as gears 7, 8, and 9 and the clutch members 29 and 32. The shaft driving member 32 may be in the form of an inexpensive diecasting and the flexible shaft 11 of comparatively light construction, all at a considerable saving in mnufacturing cast and a reduction in the overall weight of the device.

While herein is shown a caulking gun attachment for receiving therein a disposable caulking cartridge, it is understood that the craddle 17 thereof may be formed as a caulk receiving receptacle that could be used for dispensing bulk caulking by suitably modifying the caulk driving end 59 of the piston. Further, when using a refillable caulking receptacle, a reversible drill will enable the piston to be forcefully retracted by the power source without necessitating disconnecting the piston from the drive linkage, however, such an operation would require the same time as required to dispense the caulking from the gun and would be considered prohibitive to the average workman. A variable speed drill will further assist the operator in controlling the flow rate of the caulking from the gun. As a totally portable toal, a battery operated drill will afford other advantages.

While herein is shown one version of a caulking gun attachment for an electric hand drill that has been found satisfactory, it is understood that the device may be constructed as an integral part of the drill. Further, it is understood that many variations and modifications may be made therein without departing from the spirit and scope of the device as herein shown.

What I therefore claim and desire to cover by letters patent is:

1. A caulking gun including in combination a receptacle for receiving therein a caulking cartridge having a caulk dispensing nozzle thereon, a piston having thereon a rack gear, said piston being movable when driven through said cartridge to force caulking therein from said nozzle, driving means for said piston including a pinion gear threadedly engaging said rack gear upon said piston and operative when rotated to drive said piston through said cartridge, a speed reducing drive train disposed for connecting said pinion gear with a power source, said drive train being operative when driven by said power source to affect rotation of said pinion gear, and load responsive clutch means in said drive train between said power source and said piston and operative upon a predetermined movement arresting force applied to said piston during operation of said power source to drivably disengage said piston from said power source.

2. A caulking gun as claimed in claim 1 wherein said load responsive clutch means includes means for adjusting said clutch means to control slippage in said drive train between said power source and said piston to selectively regulate the pressure applied by said piston to the caulking in said receptacle during operation of said power source.

3. A caulking gun as claimed in claim 1 including means movable for shifting the said pinion gear from its driving engagement with the rack gear upon said piston to allow manual movement of said piston.

4. A caulking gun as claimed in claim 1 including means movable for drivably disengaging said pinion gear from said drive train for allowing manual movement of said piston with said rack gear freely rotating the pinion gear.

5. A caulking gun as claimed in claim 1 wherein said clutch means in said drive train is adjustable to effect controlled slippage in said drive train at said clutch and between said power source and said piston during operation of said power source to vary selectively the pressure as applied by said piston to the caulking in said receptacle.

6. A caulking gun as claimed in claim 1 wherein said caulking cartridge is refillable.

7. A caulking gun attachment for an electric hand drill including in combination securing means for fastening said gun to the body of said drill, a caulk retaining receptacle forming a part of said gun and fastened to said securing means, a dispensing nozzle in communication with said receptacle to dispense caulking from said receptacle, a piston having a rack gear thereon movable when driven through said receptacle to force caulking therein from said nozzle, a pinion gear drivably engaging said rack gear on said piston and operative when rotated, to effect movement of said piston through said receptacle, means for rotating said pinion gear including a drive train connectable with said drill for being driven by operation of said drill and load responsive clutch means interposed in said drive train between said drill and said piston to drivably disengage said drill from said piston upon a predetermined movement arresting pressure being applied to said piston during operation of said drill.

8. A caulking gun as claimed in claim 7 wherein said load responsive clutch means includes means for adjusting said clutch means to control slippage in said drive train to selectively regulate the pressure applied by said piston to the caulking in said receptacle independent of the drill speed.

9. A caulking gun as claimed in claim 7 including means movable for shifting the said pinion gear from its driving engagement with the rack gear upon siad piston to allow manual movement of said piston.

10. A caulking gun as claimed in claim 7 including means movable for drivably disengaging said pinion gear from said drive train for allowing manual movement of said piston by the rack gear thereon rotating freely the pinion gear.

11. A caulking gun attachment for an electric hand drill as claimed in claim 8 wherein said clutch means in said drive train is adjustable to effect controlled slippage in said drive train between said drill and said piston during operation of said drill to vary selectively the pressure as applied by said piston to the caulking in said receptacle.

12. A caulking gun attachment for an electric hand drill as claimed in claim 8 wherein the caulk retaining receptacle is in the form of a disposable cartridge.

* * * * *